US006439387B1

(12) United States Patent
Bergman

(10) Patent No.: US 6,439,387 B1
(45) Date of Patent: Aug. 27, 2002

(54) LIQUID DETERGENT CONTAINER AND DISPENSING

(75) Inventor: Daniel Bergman, Brooklyn, NY (US)

(73) Assignee: Air Fresh Inc., North Brunswick, NJ (US)

( * ) Notice: Subject to any disclaimer, the term of this patent is extended or adjusted under 35 U.S.C. 154(b) by 0 days.

(21) Appl. No.: 09/620,431

(22) Filed: Jul. 20, 2000

(51) Int. Cl.[7] ..... B65D 85/84
(52) U.S. Cl. ..... 206/524.4; 53/474; 510/277
(58) Field of Search ..... 206/524.1, 524.4, 206/524.5, 525; 220/359.1, 359.4; 53/440, 474; 510/276, 277

(56) References Cited

U.S. PATENT DOCUMENTS 4,605,142 A * 8/1986 Itoh et al. ..... 220/359.4
4,680,916 A * 7/1987 Ginn ..... 53/474
5,055,215 A * 10/1991 Mains et al. ..... 510/277
5,213,227 A * 5/1993 Koyama et al. ..... 220/359.4
5,316,603 A * 5/1994 Akazawa et al. ..... 220/359.4
5,627,150 A * 5/1997 Peterson et al. ..... 206/525
6,040,286 A * 3/2000 Huff ..... 206/524.1

* cited by examiner

*Primary Examiner*—Luan K. Bui
(74) *Attorney, Agent, or Firm*—Israel Nissenbaum; Marvin Feldman

(57) ABSTRACT

A method of packaging liquid detergent or fabric softener for single load use comprising thermoforming a container from a thermoplastic material such as polypropylene, polyethylene, polystyrene and the like, to a size sufficient to contain a 3–4 ounce amount of liquid detergent in a well thereof. The container comprises an open well with a peripheral lip an open end thereof. A printed foil strip, sized to cover the opening and at least a full circumferential portion of the container lip is heat sealed to the thermoplastic after the detergent is disposed therein. The foil and heat seal are of sufficient strength to retain the 3–4 ounces of liquid detergent even in an obverted position with jostling such as drug transport. Because of the heat seal, the container is not reclosable and storable and the full contents must be used once the container is opened, i.e., for a single use.

9 Claims, 1 Drawing Sheet

LIQUID DETERGENT CONTAINER AND DISPENSING

FIELD OF THE INVENTION

This invention relates to liquid detergents and fabric softeners and the packaging thereof.

BACKGROUND OF THE INVENTION

Liquid detergents and fabric softeners are packaged and sold in quantities sufficient for multiple uses or washing loads, i.e., generally for household use where numerous washings take place (volume use of liquid detergents and fabric softeners is roughly equal on a volume basis). The cost of packaging, with molded containers and screw caps suitable for retaining such significant amounts of detergent or fabric softener liquids, is a significant portion of the total cost of the detergent. Though solid detergents are available in small tear open packets there are no similar packages of liquid detergents despite the popularity of such liquid detergents for use in Laundromats and by singles without families where the number of wash loads is usually minimal.

Generally, with deviations in scale, the cost of providing similar, smaller containers with lesser mounts of detergent liquids is normally greater on a proportional basis, especially since liquids are more difficult to package and contain. More economical tear open packets of liquid detergent would be significantly larger than equivalent powder detergent packages (about 3–4 fluid ounces of liquid detergent or fabric softeners are generally required for a single wash load) and would require tougher and leak resistant containment materials, which by this very requirement, are difficult and very inconvenient to tear open especially without accidental spillage. Accordingly, it has not been considered economically feasible to provide packages with single use amounts of liquid detergents or fabric softeners.

SUMMARY OF THE INVENTION

It is accordingly an object of the present invention to provide a method and container for the economical containment of small amounts of a liquid detergent or fabric softener, sufficient for an average single use, in a non-closable, non-storable, non-reusable economical container which is resistant to accidental spillage but which is readily openable for use.

It is a further object of the present invention to provide said single use amount of detergent and fabric softener is a container suitable for use in a vending machine for use in commercial Laundromats.

It is yet a further object of the present invention to provide a convenient packaged form for liquid detergent or fabric softener which requires no measuring or other handling.

Generally the present invention comprises a method and container package for conveniently packaging single use amounts of a liquid detergent or fabric softener in a non-re-closable, non-reusable, non-storable container, comprising the steps of:

a) thermoforming a self-standing container with an open well, of a size sufficient to contain enough liquid detergent or fabric softener sufficient for a single average wash load, said container being formed from a thermoplastic material (e.g., polypropylene, polyethylene, polystyrene and the like), with said well having an opening, completely peripherally bounded with a peripheral outwardly extending short ledge;

b) filling the container with an amount of liquid detergent or fabric softener sufficient only for about a single average wash load;

c) placing a cover sheet of a heat sealable material on the ledge around the opening of the well and enclosingly across the opening of the well and fully heat sealing the cover sheet to sealingly enclose the liquid within said container, wherein said cover sheet is congruently sized to the areal dimensions of the opening of the well and the ledge therearound, and wherein a portion of the cover sheet is manually accessible for gripping in peeling off the cover sheet from the container when the detergent or fabric softener is to be used, wherein the heat seal is of sufficient tensile strength to resist accidental opening of the container but wherein the heat seal has a low peel strength for facilitated peeling removal of the cover sheet without jerking or the leaving of a remaining residue.

The cover sheet is preferably a thin metal foil such as of aluminum and is preferably pre-printed with manufacturer identification, trademark(s), and usage instructions. The metal is dimensioned to provide sufficient retaining strength for the contained liquids even under jostling shipping and handling conditions. A cover sheet of the same material as the container is to be avoided since the heat seal is more of a material weld and is difficult to separate, especially without leaving a torn residue.

Cost of the individual-use packaging of the present invention which is non-reusable and non-storable is significantly lower than the cost of packaging for liquid detergent or fabric softeners as currently utilized even on a very favorable proportional basis by a factor of at least 5 to 1.

The above and other features and advantages of the present invention will become more evident from the following discussion and drawings in which:

SHORT DESCRIPTION OF THE DRAWINGS

DETAILED DESCRIPTION OF THE INVENTION

The containers made in accordance with the present invention are formed with frusto-conical sloped walls whereby the cups can be nested within each other for facilitated storage and processing. The peripheral ledges are preferably configured with a flat upper surface for heat sealing with the cover sheet and with a channeled lower surface to enhance structural rigidity. A peripheral indent in the wall of the container permits offset nesting of the containers for easy removal separation from each other. The peripheral ledges are minimized in lateral extent to concomitantly minimize peeling effort but are sufficiently wide enough to effect a heat seal of the requisite strength. A ⅛ inch extension is an effective width for a container with approximate dimensions of 1.8" height and 2.75" diameter opening. Because of the frusto-conical structure, the base of the cup has a smaller diameter of about 2.4" to provide a well sufficient to contain the requisite maximum of four ounces of liquid. Though the containers may be larger and capable of containing more liquid, it is preferred that the volume of the container not be more than 25% above the volume actually required by the liquid.

The containers are preferably made of polystyrene with an indent base to increase structural strength thereof.

An extending tab section of the cover sheet is folded down when not used and lifted as a starting lever for removal of the cover sheet from the container when the detergent is to be used. After removal of the cover sheet, the liquid detergent or fabric softener is poured into the wash load, at an appropriate point of the wash cycle without measuring or manipulation and the container and cover are discarded. No portion of the detergent can be readily stored since the contained amount is pre-measured for the load and the cover sheet cannot be re-adhered (absent a second heat sealing) and is too small to otherwise be wrapped around the container opening and a liquid in an open cup is not readily stored without spillage.

A normal wash load amount for a non-concentrated detergent or fabric softener is about 3–4 ounces with concentrated liquids being proportioned therefrom. The container is thus provided with a well capable of containing at least the maximum of 4 ounces.

DETAILED DESCRIPTION OF THE DRAWINGS AND THE PREFERRED EMBODIMENT

Figure 1:
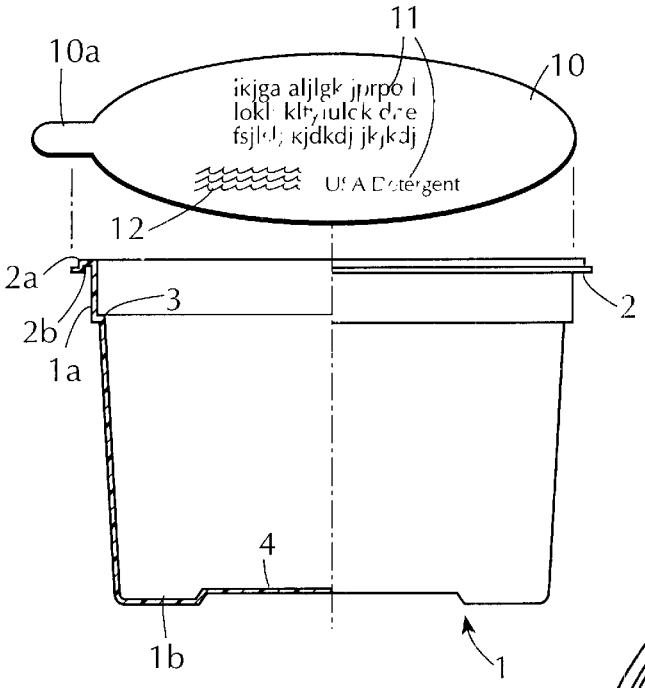
FIG. 1 is a partial sectioned side view of a container made in accordance with the present invention with a cover sheet being placed thereon.
Figure 2:
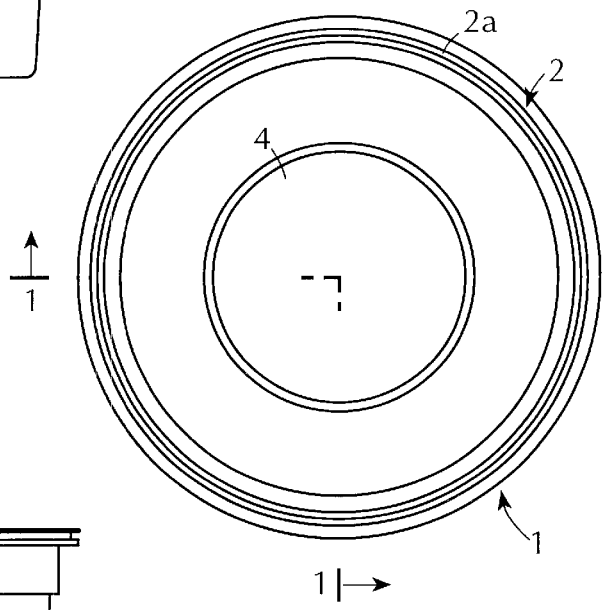
FIG. 2 is a top view of the open container of FIG. 1.
Figure 3:
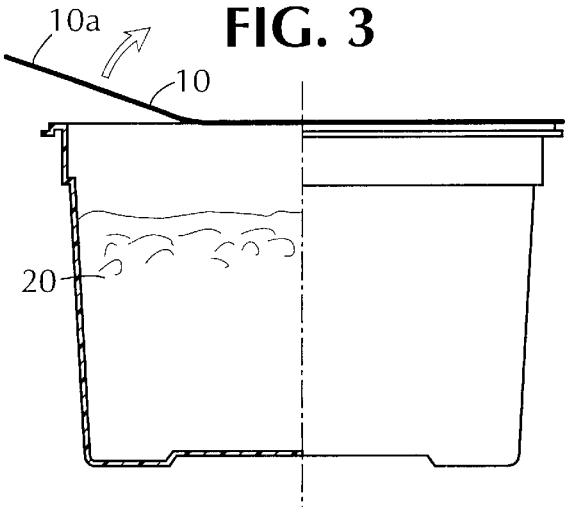
FIG. 3 is the container of FIG. 1, having been sealed by the cover sheet and filled with liquid detergent, as it is being opened.

With reference to the drawings, in FIG. 1 a thermoformed container cup 1 having a capacity of about 4.5 to 5 fluid ounces of liquid detergent or fabric softener. The container 1 is of frusto-conical shape with a wider opening 1*a* than the closed base 1*b*, whereby multiple cups may be readily nested. Ledge 2 peripherally completely surrounds the opening (as more clearly seen in FIG. 2) with flat upper surface 2*a* for heat sealing with foil cover sheet 10. Lower ledge surface 2*b* is channel shaped for rigidity and structural strength to withstand peeling forces when the cover sheet 10 is removed therefrom (FIG. 3). Indent 3 is adapted to rest on the succeeding ledge 2 of a second container into which container 1 is nested, in a stack of containers used for processing. The base 1*b* of the container comprises a circular recess 4 to impart further rigidity to the base of the container and to enhance standing stability.

As seen in FIG. 3, cover sheet 10 is printed with indicia of manufacturer and trademarks 11 and instructions 12 and container 1 is substantially filled with liquid detergent 20, pre-measured for a single wash load. Cover sheet 10 is sized to fit on ledge 2 with tab extension 10 used to grasp the cover sheet for peeling removal, as shown. Cover sheet 10 is not redeployable and is either entirely or partially removed and the detergent 20 is poured into the wash load, as required, and the cover sheet 10 and container are discarded. With the minimal size of the containers and the standing stability thereof, they may be individually sold in vending machines at Laundromats for on site use or they may be used as single use conveniences and sold in packs such as six-packs with an appropriate carrier.

It is understood that the above description and drawings showing a particular embodiment are merely illustrative of the present invention and that changes may be made in the structure, components and configuration of the container and cover without departing from the scope of the present invention, as defined in the following claims.

What is claimed is:

1. A method for packaging single use amounts of any of a wash water usable pourable liquid detergent or wash water usable pourable liquid fabric softener in a container, comprising the steps of:

a) thermoforming a self-standing container with an open well, of a size sufficient to contain enough pourable liquid detergent or pourable liquid fabric softener sufficient for a single average laundry wash load, said container being formed from a thermoplastic material, with said well having an opening, completely peripherally bounded with a peripheral outwardly extending short ledge;

b) filling the container with an amount of the pourable liquid detergent or pourable liquid fabric softener, sufficient only for about a single average laundry wash load;

c) placing a cover sheet of a heat sealable material on the ledge around the opening of the well and enclosingly across the opening of the well and fully heat sealing the cover sheet to sealingly enclose the pourable liquid within said container and wherein a portion of the cover sheet is manually accessible for gripping in peeling off the cover sheet from the container when the detergent or fabric softener is to be used;

wherein the heat seal is of sufficient tensile strength to resist accidental opening of the container but wherein the heat seal has a low peel strength for facilitated peeling removal of the cover sheet without jerking or the leaving of a remaining residue, whereby the cover sheet is not sealingly replaceable to close said container for non-spill storage or reuse of any pourable liquid detergent or pourable liquid fabric softener remaining in said container.

2. The method of claim 1, wherein said cover sheet comprises a printed metal foil sheet with indicia of manufacturer, trademark and instructions thereon.

3. The method of claim 1, wherein said amount of liquid detergent or fabric softener is up to about 4 ounces and said container is adapted for the containment thereof.

4. The method of claim 1, wherein said container comprises a frusto-conical configuration.

5. The method of claim 1, wherein said container comprises a closed base with a circular recessed offset therein.

6. The method of claim 1, wherein said ledge is formed with a flat upper surface adapted for heat sealing to said cover sheet and a channeled lower surface to impart rigidity to said ledge.

7. A container, with one of wash water usable pourable liquid detergent and wash water usable pourable liquid fabric softener sealingly contained therein, for single use with an average laundry wash load, said container being self-standing and, formed from a thermoplastic material and having an open well, of a size sufficient to contain enough pourable liquid detergent or pourable liquid fabric softener sufficient for a single average laundry wash load, with said well having an opening, completely peripherally bounded with a peripheral outwardly extending short ledge; said container further comprising a cover sheet of a heat sealable material on the ledge around the opening of the well and enclosingly across the opening of the well and fully heat sealed to said ledge to sealingly enclose the pourable liquid within said container and wherein a portion of the cover sheet is manually accessible for gripping in peeling off the cover sheet from the container when the detergent or pourable liquid fabric softener is to be used;

wherein the heat seal is of sufficient tensile strength to resist accidental opening of the container but wherein the heat seal has a low peel strength for facilitated peeling removal of the cover sheet without jerking or the leaving of a remaining residue, whereby the cover sheet is not sealingly replaceable to close said container for non-spill storage or reuse of any pourable liquid detergent or pourable liquid fabric softener remaining in said container.

8. A method for packaging single use amounts of any of a wash water usable pourable liquid detergent or wash water usable pourable liquid fabric softener in a container, comprising the steps of:

a) thermoforming a self-standing container with an open well, of a size sufficient to contain enough pourable liquid detergent or pourable liquid fabric softener sufficient for a single average laundry wash load, said container being formed from a thermoplastic material, with said well having an opening, completely peripherally bounded with a peripheral outwardly extending short ledge;

b) filling the container with an amount of the pourable liquid detergent or pourable liquid fabric softener, sufficient only for about a single average laundry wash load;

c) placing a cover sheet of a heat sealable material on the ledge around the opening of the well and enclosingly across the opening of the well and fully heat sealing the cover sheet to sealingly enclose the pourable liquid within said container and wherein a portion of the cover sheet is manually accessible for gripping in peeling off the cover sheet from the container when the detergent or fabric softener is to be used;

wherein the heat seal is of sufficient tensile strength to resist accidental opening of the container but wherein the heat seal has a low peel strength for facilitated peeling removal of the cover sheet without jerking.

9. A container, with one of wash water usable pourable liquid detergent and wash water usable pourable liquid fabric softener sealingly contained therein, for single use with an average laundry wash load, said container being self-standing and formed from a thermoplastic material and having an open well, of a limited size to contain only a premeasured amount of pourable liquid detergent or pourable liquid fabric softener sufficient for a single average laundry wash load, said well having an opening, a peripheral outwardly extending ledge contiguous with said well and juxtaposed to said opening, said container further comprising a cover sheet of a heat sealable material disposed on the ledge around the opening of the well and enclosingly the opening of the well said cover sheet being fully heat sealed to said ledge from above to sealingly enclose the pourable liquid within said container and wherein a portion of the cover sheet is manually accessible for gripping in peeling off the cover sheet from the container when the detergent or pourable liquid fabric softener is to be used;

wherein the heat seal is of sufficient tensile strength to resist accidental opening of the container but wherein the heat seal has a sufficiently low peel strength for facilitated peeling removal of the cover sheet without jerking.

* * * * *